US007159318B1

(12) United States Patent
Farag

(10) Patent No.: US 7,159,318 B1
(45) Date of Patent: Jan. 9, 2007

(54) NAIL CUTTER

(76) Inventor: Ehad Farag, 1860 Montgomery Ave., Villanova, PA (US) 19085

( * ) Notice: Subject to any disclaimer, the term of this patent is extended or adjusted under 35 U.S.C. 154(b) by 59 days.

(21) Appl. No.: 11/141,147

(22) Filed: May 31, 2005

Related U.S. Application Data

(60) Provisional application No. 60/663,045, filed on Mar. 17, 2005.

(51) Int. Cl.
*A45D 29/00* (2006.01)
*B26B 13/22* (2006.01)

(52) U.S. Cl. ..... 30/28; 30/124; 30/279.2; 30/299; 30/315; 132/75.5; 28/60

(58) Field of Classification Search ..... 30/26–29, 30/111, 113, 143, 123–125, 145, 182, 208, 30/175, 341, 186, 501, 279.2, 287, 280, 294, 30/299, 35; 132/75.5, 73.5, 75.4, 75.3, 75.6, 132/76.2, 76.4, 73; D8/5, 8, 52, 59; 7/162; D28/60–62, 56–57, 59
See application file for complete search history.

(56) References Cited

U.S. PATENT DOCUMENTS

| | | | | |
|---|---|---|---|---|
| 4,027,386 | A | 6/1977 | Spinosa | |
| 4,117,591 | A | 10/1978 | Terry | |
| 5,195,544 | A | 3/1993 | Campagna | |
| D353,687 | S * | 12/1994 | Dacko | D28/60 |
| 5,570,509 | A * | 11/1996 | Killian | 30/28 |
| D402,410 | S * | 12/1998 | Farrell | D28/60 |
| 6,523,545 | B1 * | 2/2003 | Rende | 132/75.5 |
| 6,941,657 | B1 * | 9/2005 | Choi et al. | 30/28 |
| 7,024,774 | B1 * | 4/2006 | Novellie et al. | 30/28 |

* cited by examiner

*Primary Examiner*—Boyer D. Ashley

(57) ABSTRACT

An apparatus for cutting an individual's fingernails. The apparatus has a plurality of holes into which a finger nail can be inserted to be clipped. The apparatus also has an internal reservoir for storage of finger nail clippings and also has placements of animal heads and animal body parts to help give the apparatus a more homely feel to it.

4 Claims, 2 Drawing Sheets

NAIL CUTTER

I. CROSS-REFERENCE TO RELATED APPLICATIONS

This application claims the benefit of U.S. Provisional Application No. 60/663,045, filed Mar. 17, 2005.

II. BACKGROUND OF THE INVENTION

The present invention concerns that of a new and improved apparatus for cutting an individual's fingernails.

III. DESCRIPTION OF THE PRIOR ART

U.S. Pat. No. 5,195,544, issued to Campagna, discloses a nail catcher and case.

U.S. Pat. No. 4,117,591, issued to Terry, discloses a nail clipper having a dual edge cutting device suited to slice through a nail positioned for clipping and includes a receiver.

U.S. Pat. No. 4,027,386, issued to Spinosa, discloses a nail cutting implement comprised of a blade and handle that can be used to slice a number of items.

IV. SUMMARY OF THE INVENTION

The present invention concerns that of a new and improved apparatus for cutting an individual's fingernails. The apparatus has a plurality of holes into which a finger nail can be inserted to be clipped. The apparatus also has an internal reservoir for storage of finger nail clippings and also has placements of animal heads and animal body parts to help give the apparatus a more homely feel to it.

There has thus been outlined, rather broadly, the more important features of a household apparatus that the detailed description thereof that follows may be better understood and in order that the present contribution to the art may be better appreciated. There are, of course, additional features of the household apparatus that will be described hereinafter and which will form the subject matter of the claims appended hereto.

In this respect, before explaining at least one embodiment of the household apparatus in detail, it is to be understood that the household apparatus is not limited in its application to the details of construction and to the arrangements of the components set forth in the following description or illustrated in the drawings. The household apparatus is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present household apparatus. It is important, therefore, that the claims be regarded as including such equivalent constructions insofar as they do not depart from the spirit and scope of the present invention.

It is therefore an object of the present invention to provide a household apparatus which has all of the advantages of the prior art and none of the disadvantages.

It is another object of the present invention to provide a household apparatus which may be easily and efficiently manufactured and marketed.

It is another object of the present invention to provide a household apparatus which is of durable and reliable construction.

It is yet another object of the present invention to provide a household apparatus which is economically affordable and available for relevant market segment of the purchasing public.

Other objects, features and advantages of the present invention will become more readily apparent from the following detailed description of the preferred embodiment When considered with the attached drawings and appended claims.

V. BRIEF DESCRIPTION OF THE DRAWINGS

VI. DESCRIPTION OF THE PREFERRED EMBODIMENT

Figure 1:
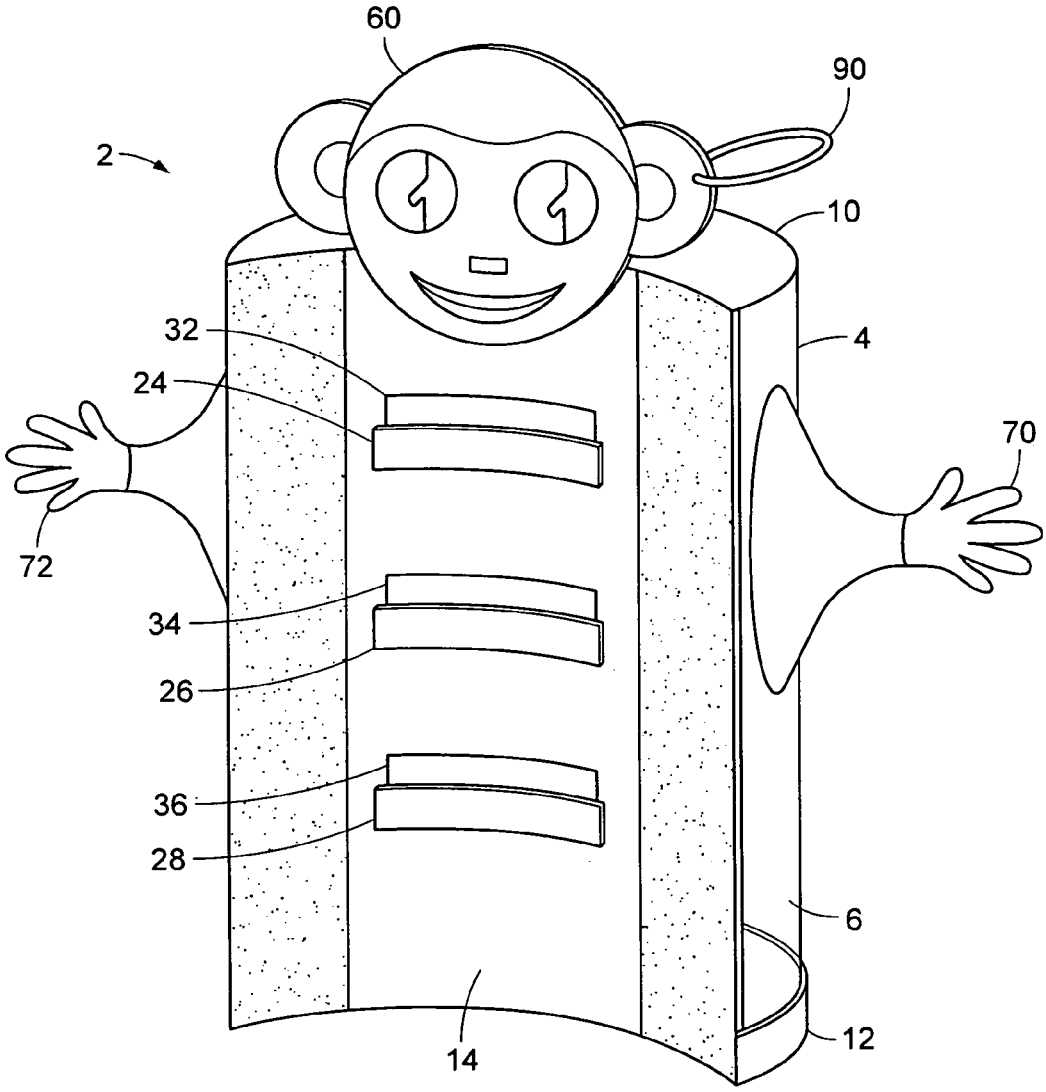
FIG. 1 shows a front perspective view of the finger nail clipper.
Figure 2:
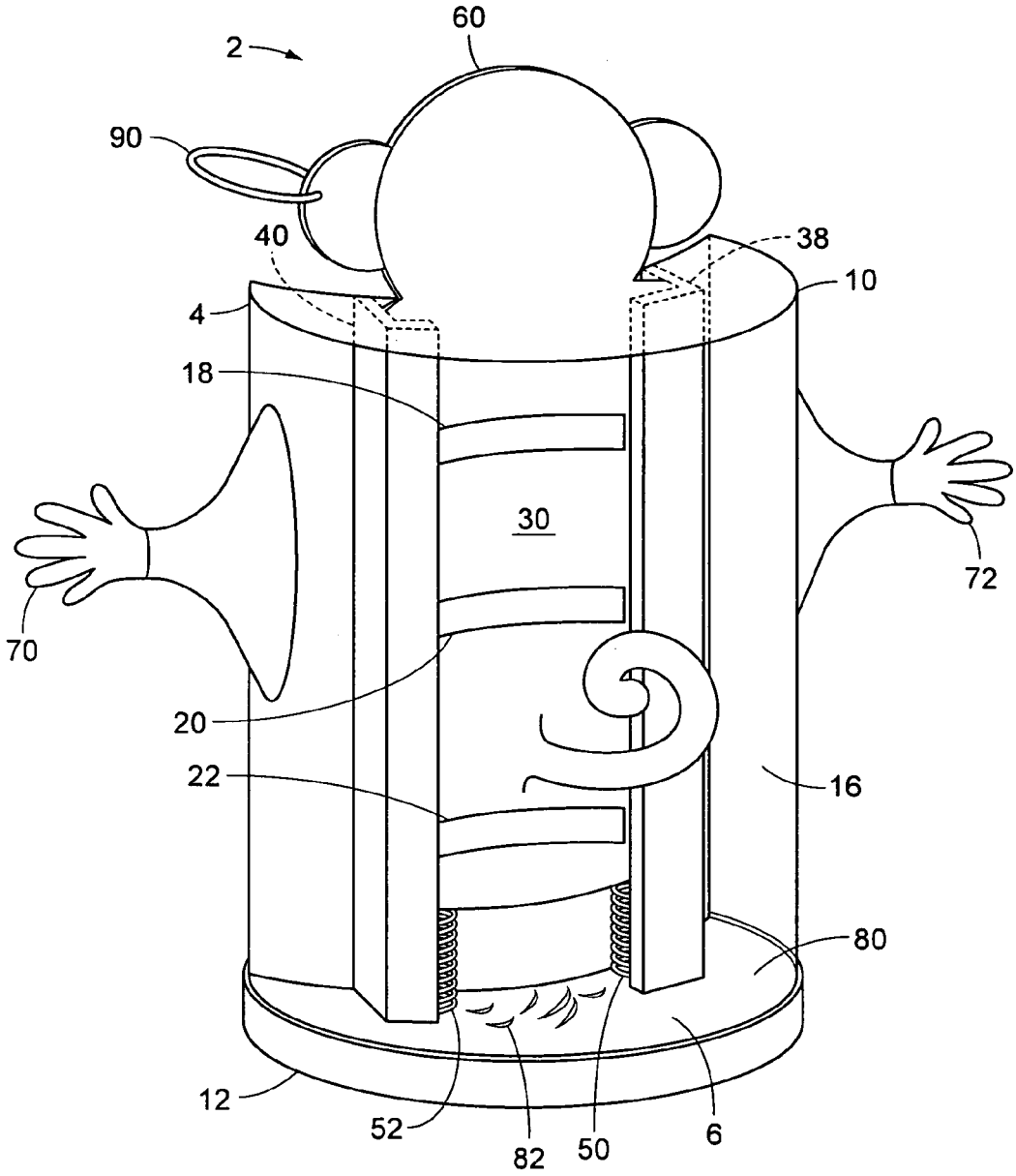
FIG. 2 shows a rear perspective view of the finger nail clipper.

FIG. 1 shows a front perspective view of the finger nail clipper 2, while FIG. 2 shows a rear perspective view of the finger nail clipper 2. Finger nail clipper 2 is designed to have an outer casing 4 and also have an internal reservoir 6 to capture fingernail clippings that are cut by the finger nail clipper 2.

The outer casing 4 has two ends, a top end 10 and a bottom end 12, and furthermore, has two surfaces, a front surface 14 and a rear surface 16. The front surface 14 is concave, while the rear surface 16 is convex. The front surface of the outer casing 4 has at least three different holes 18, 20, and 22 of varying size to make cutting of all types of fingernails possible. Each hole has a much larger length than width, with the width being quite narrow. The width for each hole is so narrow it only allows for insertion of a fingernail portion.

Underneath the holes 18, 20, and 22 are located ledges 24, 26, and 28, for placement of fingers when a fingernail is being inserted into a hole and to protect fingers from touching the sharp blades.

Located within the internal reservoir is a cutting plate 30 that has three bladed holes 32, 34, and 36, with the cutting plate 30 having a top end and a bottom end. The cutting plate 30 is mounted within two tracks 38 and 40, with the cutting plate 30 being placed slightly off of the bottom end 12 of the outer casing 4 by a pair of springs 50 and 52. The blades 32–36 themselves are normally right above the location of the holes 18–22 and will cut any finger nail that is inserted into a hole 18–22 when the cutting plate 30 is then pushed downward.

To aid an individual in pushing down the cutting plate, the top end of the cutting plate has a head 60 that could take any dimensioned shape as long as it gives a natural looking of the body and ensure the comfort of the thumb pushing the head up and down. The head 60 also gives the finger nail clipper 2 a little more homeliness when the finger nail clipper 2 is being used.

A pair of arms 70 and 72 can also be attached to the side of the outer casing 4, which will give an added personalized feel to the finger nail clipper 2.

The bottom end 12 of the outer casing 4 has a door 80 that is downwardly openable. The door 80 allows for the fingernail clippings 82 that might be within the internal reservoir 6 to be easily removed as needed so the finger nail clipper 2 can be cleaned.

Finger nail clipper 2 also has a key chain 90 that is set to be attached to the animal head 60. The key chain 90 is attached in such a manner to mimic that of an earring, and can be used to attach the finger nail clipper 2 to a set of keys.

What I claim as my invention is:

1. A household apparatus for cutting fingernails, the household apparatus comprising:

(a) an outer casing having two ends, a top end and a bottom end, the outer casing further comprising two surfaces, a front surface and a rear surface, (b) an internal reservoir located within the outer casing, (c) at least three holes located on the front surface of the outer casing, each of the holes having a different size, each hole having a length and a width, (d) a plurality of ledges, wherein a ledge is located immediately underneath each hole, (e) a cutting plate located within the internal reservoir, the cutting plate being mounted on a pair of tracks located within the internal reservoir comprising a first track and a second track, (f) a plurality of bladed holes located on the cutting plate, each of the bladed holes being located immediately above the location of the holes on the front surface of the outer casing, (g) means for placing the cutting plate slightly off of the bottom end of the outer casing, (h) a representational head attached to the top end of the cutting plate, (i) a representational pair of arms comprising a left arm and a second arm, the representational pair of arms being attached to the sides of the outer casing, (j) a door located at the bottom end of the outer casing, the door being downwardly openable, and (k) a key chain attached to the representational head, the key chain attached to the head in such a manner to have the appearance of an earring.

2. A household apparatus for cutting fingernails according to claim 1 wherein the front surface of the outer casing is concave, and further wherein the rear surface of the outer casing is convex.

3. A household apparatus for cutting fingernails according to claim 2 wherein the width for each hole is so narrow it only allows for insertion of a fingernail portion of a finger.

4. A household apparatus for cutting fingernails according to claim 3 wherein the means for placing the cutting plate slightly off of the bottom end of the outer casing further comprises a pair of springs.

* * * * *

UNITED STATES PATENT AND TRADEMARK OFFICE

CERTIFICATE OF CORRECTION

PATENT NO. : 7,159,318 B1
APPLICATION NO. : 11/141147
DATED : January 9, 2007
INVENTOR(S) : Ehab Farag It is certified that error appears in the above-identified patent and that said Letters Patent is hereby corrected as shown below:

On the title page item (76), the correct name of the inventor is Ehab Farag.

Signed and Sealed this

Thirtieth Day of December, 2008

JON W. DUDAS
*Director of the United States Patent and Trademark Office*